US005717823A

United States Patent [19]

Kleijn

[11] Patent Number: 5,717,823

[45] Date of Patent: Feb. 10, 1998

[54] SPEECH-RATE MODIFICATION FOR LINEAR-PREDICTION BASED ANALYSIS-BY-SYNTHESIS SPEECH CODERS

[75] Inventor: Willem Bastiaan Kleijn, Basking Ridge, N.J.

[73] Assignee: Lucent Technologies Inc., Murray Hill, N.J.

[21] Appl. No.: 227,845

[22] Filed: Apr. 14, 1994

[51] Int. Cl.[6] ..... G10L 3/02; G10L 9/00

[52] U.S. Cl. ..... 395/2.29; 395/2.32; 395/2.94

[58] Field of Search ..... 395/2.29, 2.28, 395/2.2, 2.32, 2.91–2.94; 381/34–40, 2.67

[56] References Cited

U.S. PATENT DOCUMENTS

| | | | |
|---|---|---|---|
| 4,435,832 | 3/1984 | Asada et al. | 381/34 |
| 4,550,425 | 10/1985 | Anderson et al. | 381/30 |
| 4,709,390 | 11/1987 | Atal et al. | 381/51 |
| 4,833,718 | 5/1989 | Sprague | 381/52 |
| 4,864,620 | 9/1989 | Bialick | 381/34 |
| 4,885,790 | 12/1989 | McAulay et al. | 381/36 |
| 5,054,072 | 10/1991 | McAulay et al. | 381/31 |
| 5,175,769 | 12/1992 | Hejna, Jr. et al. | 381/34 |
| 5,327,518 | 7/1994 | George et al. | 395/2.2 |
| 5,341,432 | 8/1994 | Suzuki et al. | 381/34 |

FOREIGN PATENT DOCUMENTS

| | | | |
|---|---|---|---|
| 0564669 A1 | 4/1992 | European Pat. Off. | H04M 3/50 |
| 0573358 A1 | 2/1993 | European Pat. Off. | G10L 3/02 |
| 2254524 | 7/1992 | United Kingdom | H04M 1/65 |

OTHER PUBLICATIONS

European Search Report.

W. Verhelst et al., "An Overlap–Add Technique Based On Waveform Similarity (WSOLA) for High Quality Time–Scale Modification of Speech," *IEEE*, 554–557 (1993).

W. B. Kleijn et al., "An Efficient Stochastically Excited Linear Predictive Coding Algorithm for High Quality Low Bit Rate Transmission of Speech," *Speech Communication*, vol. 7, 305–316 (1988).

K. K. Paliwal et al., "Efficient Vector Quantization of LPC Parameters at 24 Bits/Frame," *IEEE Transactions on Speech and Audio Processing*, vol. 1, No. 1, 3–14 (Jan. 1993).

P. Kroon et al., "On the Use of Pitch Predictors with High Temporal Resolution," *IEEE Transactions on Signal Processing*, vol. 39, No. 3, 733–735 (Mar. 1991).

*Primary Examiner*—Allen R. MacDonald

*Assistant Examiner*—Patrick N. Edouard

*Attorney, Agent, or Firm*—Thomas A. Restaino; Kenneth M. Brown

[57] ABSTRACT

Synergy between operations performed by a speech-rate modification system and those operations performed in a speech coding system is exploited to provide a speech-rate modification system with reduced hardware requirements. The speech rate of an input signal is modified based on a signal representing a predetermined change in speech rate. The modified speech-rate signal is then filtered to generate a speech signal having increased short-term correlation. Modification of the input speech signal may be performed by inserting in the input speech signal a previous sequence of samples corresponding substantially to a pitch cycle. Alternatively, the input speech signal may be modified by removing from the input speech signal a sequence of samples corresponding substantially to a pitch cycle.

22 Claims, 3 Drawing Sheets

SPEECH-RATE MODIFICATION FOR LINEAR-PREDICTION BASED ANALYSIS-BY-SYNTHESIS SPEECH CODERS

The present invention is related generally to systems which modify speech rate and to linear-prediction based analysis-by-synthesis speech coding systems

BACKGROUND OF THE INVENTION

Speech-rate modification systems play back stored speech at a rate different from the rate at which it was recorded. The play-back rate may be either faster or slower than the rate of the original speech signal. A higher play-back rate allows a listener to receive a recorded message in less time, while a lower rate may be useful when writing down the message (machine dictation), or to understand the speaker better.

To reduce the cost of storing speech for subsequent play-back, many systems employ a speech compression (or coding) technique, such as the well-known analysis-by-synthesis coding techniques (e.g., CELP). Speech coding systems convert a digital speech signal into a coded signal. The coded signal requires less storage space than the original speech signal. During signal play-back, the coded signal forms the input to the decoding part of the speech coder, which is referred to as a "synthesizer." The synthesizer converts the coded signal back to a digital speech signal.

A challenge in the design of speech-rate modification systems is to design the system without substantially altering the characteristics of speech, other than rate. Voiced speech has three major attributes: its short-term correlation (or spectral envelope), its quasi-periodic nature, and its pitch. If the short-term correlation of a speech signal is disturbed, pop and click sounds may become audible. If the quasi-periodic nature of voiced speech is disturbed, the speech may sound buzzy or noisy. These two distortions are not created by simply speeding-up or slowing down the speech signal rate (equivalent to speeding-up or slowing down an analog tape in playback mode). However, such speeding-up and slowing down does change the pitch of the speech signal dramatically altering the perceived nature of the speech. Speech played at an increased rate, for example, may sound like a cartoon character (e.g., the well-known Chipmunk characters). The challenge is thus to provide a speech-rate modification system which does not alter these attributes, and in particular speech signal pitch.

It is known in the art that speech-rate of an original voiced speech signal may be modified by the removal or addition of signal samples from which correspond to an integer number of pitch-cycles. By doing so, the original signal may be shortened or lengthened without substantially altering the pitch of the signal. Because an original voiced speech signal is quasi-periodic (and not perfectly periodic), it is very difficult (if not impossible) to remove or insert a pitch-cycle of speech without changing the short-term correlation of the signal and/or its periodicity. These difficulties contribute to a degradation of audible signal quality in terms of those distortions associated with short-term correlation and periodicity disturbances (pops/clicks and buzz/noise). This problem has been addressed through the use of an overlapping window procedure on original-domain speech which has been modified through the removal or insertion of pitch-cycles. See, for example, W. Verhelst and M. Roelands, "An Overlap-Add Technique Based on Waveform Similarity (WSOLA) for High Quality Time-Scale Modification of Speech," Proc. Int. Conf. Acoust. Speech Sign. Process., pII554–57 (1993).

While this technique addresses the audible distortion problems caused by pitch-cycle insertion and deletion, the combination of speech coding and speech-rate change modification systems is demanding of hardware resources. It would be desirable, therefore, to reduce the cost of providing speech-rate modification capability (when speech coding is used) through a reduction in hardware requirements.

SUMMARY OF THE INVENTION

The present invention provides a method and apparatus which exploits a synergy between the operations performed by a speech-rate modification system and those in a speech coding system to reduce hardware requirements in speech-rate modification systems.

In accordance with the present invention, the speech rate of an input speech signal is modified based on a signal representing a predetermined change in speech rate. The modified speech-rate signal is then filtered to generate a speech signal having increased short-term correlation. Modification of the input speech signal may be performed by inserting in the input speech signal a previous sequence of samples corresponding substantially to a pitch cycle. Alternatively, the input speech signal may be modified by removing from the input speech signal a sequence of samples corresponding substantially to a pitch cycle.

Embodiments of the present invention exploit synergy in speech coding and rate change operations. For example, the filtering called for in the rate change operation may be provided by a linear prediction (LPC) filter of a speech decoder. Furthermore, the pitch period required for the rate change operation is a known parameter of the speech decoder.

DETAILED DESCRIPTION

Illustrative Embodiment Hardware

Figure 1:
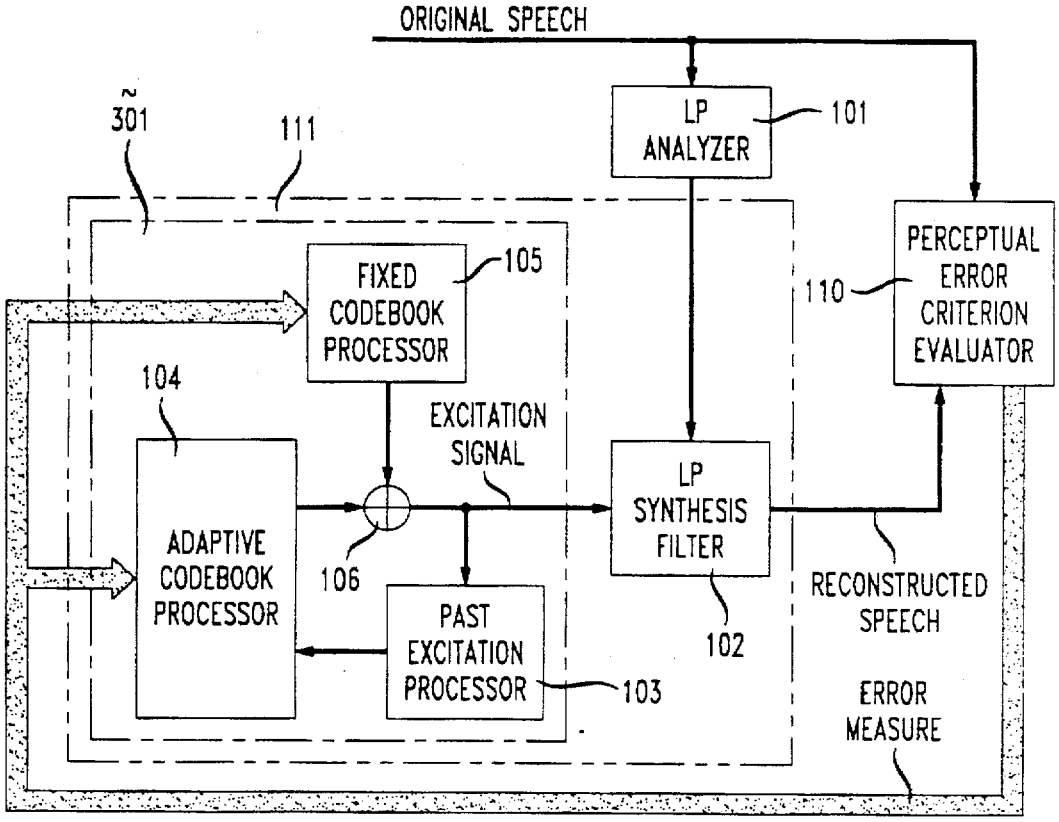
FIG. 1 presents the principle of LPAS speech coding.

For clarity of explanation, the illustrative embodiment of the present invention is presented as comprising individual functional blocks. The functions these blocks represent may be provided through the use of either shared or dedicated hardware, including, but not limited to, hardware capable of executing software. For example, the functions presented in FIGS. 1 and 3 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

Introduction to the Illustrative Embodiments

Digital storage of speech has significant advantages over conventional storage of speech on analog tape. Digital storage requires no mechanical components which require space and are subject to wear, and messages can be retrieved quickly because there is no need for the rewinding of tapes. In addition, the digital medium allows more straightforward modification of the output signal, e.g. for announcement systems where messages are composed from a dictionary of recorded words. A particularly valuable modification of the output speech signal is rate modification. A faster rate of the output speech signal allows the listener to acquire the message in a shorter amount of time, and a slower rate is useful for improved understanding or to allow time to write down, for example, a phone number.

At rates between 4 and 16 kb/s, linear-prediction based analysis by synthesis speech (LPAS) coders are commonly used for many applications, including speech storage. While the rate-change of the speech signal can be effected on the speech signal reconstructed by the coder, it is more efficient to exploit the synergy between the LPAS coders and a rate-change procedure.

For example, it is important to preserve the short-term correlation of the rate-changed speech. The short-term correlation is separated from the speech signal, to render a residual signal. The short-term correlation is added to a quantized version of the residual signal during synthesis. The lack of short-term correlation in the residual signal facilitates the rate-change process. Also, the manner in which speech segments are excised or inserted by speech-rate modification systems is based on a search for a maximum in the correlations between speech segments which are separated in time. This time-separation is already known in the adaptive codebook (or pitch predictor) of speech coding systems, saving computational effort. Furthermore, each processing operation performed on the speech signal results in added distortion. A removal of redundant operations from a combined rate modification and coding system minimizes the distortion.

It will be shown here that LPAS coders use an internal representation of the speech signal, which can be exploited for changing the rate of speech. In particular, it will be shown how the adaptive-codebook (pitch-predictor) delay parameter and the decomposition of the speech signal into a signal with low short-term correlation, and a set of short-term-correlation parameters (the linear-prediction coefficients) can be exploited in an efficient rate-change procedure for the reconstructed speech signal.

Figure 6:
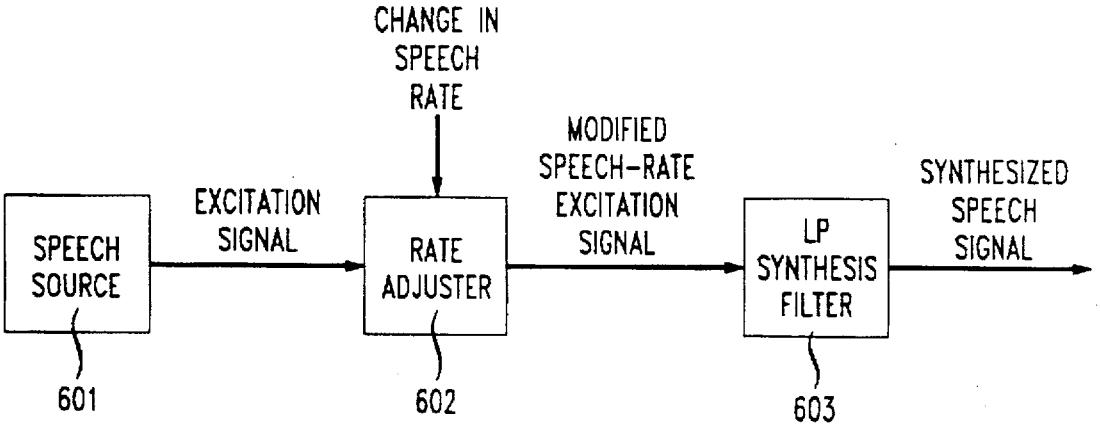
FIG. 6 presents an overview of the illustrative embodiment of FIG. 3.

FIG. 6 presents a simplified block diagram of an embodiment of the present invention for modifying the speech-rate of a speech signal. The embodiment of FIG. 6 comprises a speech signal source 601 for generating an excitation signal, a speech-rate adjuster 602, and an LPC synthesis filter 603 (other portions of the speech synthesizer of FIG. 1 are not shown for the sake of clarity of presentation). The speech signal source 601 comprises a memory which stores coded speech parameters. The source 601 further comprises a conventional excitation signal synthesis system which generates an excitation signal based on the parameters stored in memory.

The rate adjuster 602 modifies the speech rate of the excitation signal provided by the speech signal source 601 by either inserting or removing sample sequences of the excitation signal which correspond substantially to a pitch period. Inserted samples are previous samples of the excitation signal which are repeated to "stretch" (i.e., slow-down) the speech rate of the signal. Removed samples "shorten" (i.e., speed-up) the excitation signal. The insertion or removal of such samples is performed in response to a signal representing a desired change in speech-rate. The rate adjuster 602 removes and inserts speech signal samples with use of a memory which stores samples of the excitation signal. These stored samples are the source of repeated samples needed to slow-down the excitation signal. The output signal of the rate adjuster 601—an excitation signal exhibiting a modified speech-rate—is then provided to the LPC synthesis filter 603. The LPC synthesis falter 603 synthesizes a speech signal having a speech-rate corresponding to that of the output signal of the rate adjuster.

As mentioned above, the speech source 601 shown in FIG. 6 comprises a memory which stores coded speech parameters. These coded speech parameters are those generated by a speech coding system, such as a conventional CELP speech coding system well known in the art. Prior to a detailed discussion of the illustrative embodiment of the present invention, it may be instructive to consider the following description of a conventional CELP speech coding system which may be employed to code speech for storage in the memory of source 601.

Linear-Prediction Based Analysis-by-Synthesis Coding

FIG. 1 illustrates the operation of the analyzer (transmit side) of an linear-prediction based analysis-by-synthesis (LPAS) coder. The example of FIG. 1 is the well-known code-excited linear prediction (CELP) coder such as that described in e.g. W. B. Kleijn, D. J. Krasinski, R. H. Ketchum, "An Efficient Stochastically Excited Linear Predictive Coding Algorithm for High Quality Low Bit Rate Transmission of Speech", *Speech Communication* Vol. 7, p. 305–316 (1988). The coder of FIG. 1 is known as an "analysis-by-synthesis" coder because the analyzer contains an implicit synthesis structure. (Note that in computationally optimized implementations of LPAS coders, this synthesis structure may not be obvious.) In FIG. 1 the synthesis structure is contained in 111.

The coder operates on a block-by-block basis. For each block of speech a plurality of trial synthesized speech signals are compared to the original signal in the perceptual-error-criterion evaluator 111. Each block of trial synthesized speech signal is fully described by a set of indices. Any such set of indices form a code for the trial synthesized speech signal. Speech signals synthesized from a plurality of such codes are compared to the original signal for the present block. The code which results in the best match is transmitted to the receiver as the coded representation of the original speech signal. The receiver consists of a synthesizer 111, which then reconstructs this best synthesized signal for this block.

In a practical LPAS coder, the incoming speech signal is first subjected to a linear prediction analysis in analyzer 101. Analyzer 101 computes the linear prediction coefficients. These coefficients are quantized directly (not using an analysis-synthesis process), and their codes transmitted to the receiver. Generally, the linear-prediction analysis is performed once per frame (e.g. 25 ms). The linear prediction coefficients are generally interpolated to render a distinct set of coefficients for each subframe (e.g. 5 ms). The linear-prediction coefficients describe the envelope of the power spectrum of the speech signal. In the time-domain this corresponds to the short-term correlation of the speech signal. (In the field of speech coding, short-term usually refers to a time less than 2 ms, whereas long-term generally refers to a time of 2.5 to 20 ms. The former is associated with the formant structure of the speech signal, while the latter is associated with the level of the periodicity of the signal.) The linear prediction coefficients are used in a infinite-impulse response filter 102, which adds the short-term correlation to an excitation signal to generate the reconstructed speech signal.

The excitation signal which forms the input to the LP-synthesis filter 102 is quantized by an analysis-by-synthesis procedure. The excitation signal is quantized one subframe at a time. In a conventional CELP coder, the excitation signal is formed in two stages: first the adaptive codebook contribution and then the fixed-codebook contribution are determined. This two-stage procedure is preferable despite suboptimal matching because of its much lower computational complexity.

The most recent part of a past excitation signal is stored in the adaptive codebook of adaptive-codebook provider 104. For a coder operating at an 8000 Hz sampling rate and with a subframe of L samples the adaptive codebook 104 can contain 128+L−1 samples. At the start of the analysis of a new subframe, L samples furthest in the past are discarded. The last L samples (the last subframe) of selected excitation are then obtained from past-excitation-provider 103 and added to the adaptive codebook in adaptive-codebook provider 104. The adaptive codebook provider 104 provides all possible L sample segments of past excitation signal to the LP synthesis filter 102 (fixed-codebook provider 105 is not active during this first stage) as trial excitation signals. For example, in a simple codebook of length 128+L−1 there are 128 such trial excitation signals (below it is shown that more entries can be generated from such a codebook). The corresponding trial speech signals (the output of filter 102) are compared to original speech according to a perceptual error criterion. The best matching trial speech signal is determined by perceptual error criterion evaluator 110. For a codebook with 128 entries, the best match is encoded in 7 bits. This 7-bit codeword is transmitted to the receiver, so that it can replicate the optimal adaptive codebook contribution to the excitation signal. During the adaptive codebook search procedure, the gain of the trial excitation signals is set to its optimal value, using well-known conventional procedures, and this gain quantized after the selection of the best adaptive codebook contribution. A conventional scalar quantizer can be used for this purpose. As with the other quantization indices, the gain quantization index is transmitted to the receiver.

Figure 2:
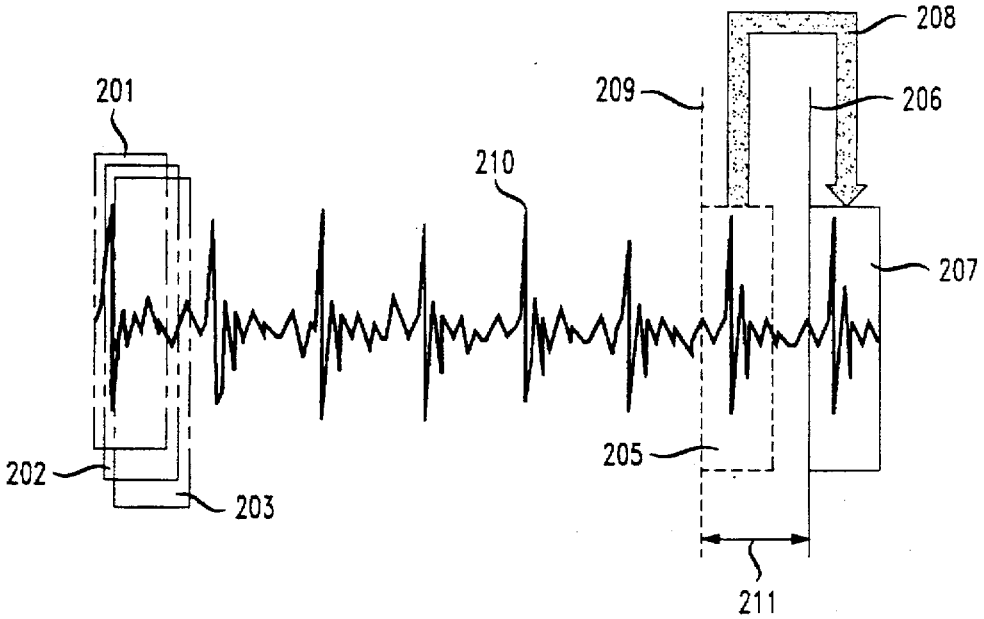
FIG. 2 presents the operation of an adaptive codebook.

The adaptive codebook memory contains segments of past excitation signals. An example of the content of the adaptive codebook memory for voiced speech is shown in FIG. 2. The current subframe is contained in 207. The part of the displayed excitation signal 210 which is before present subframe boundary 206 (i.e. to the left of this boundary) is speech stored in the adaptive codebook. The trial excitation signals are each defined by a particular square window of length L samples over the segment of past excitation signal which forms the adaptive codebook. In the example codebook shown, the first trial excitation signal is contained in window 201, the second trial excitation signal is contained in window 202, and a third is contained in 203. A typical example of a selected codebook entry is contained in window 205. The candidate codebook entries are each positioned in the present subframe along a path such as 208 for the selected entry. The time separation between the selected adaptive-codebook vector and the present subframe is often called the adaptive-codebook delay. This delay corresponds to the distance 211 between beginning 206 of the present subframe 207 and beginning 209 of the selected segment for adaptive codebook speech.

In early implementations of LPAS coders the adaptive codebook delays were constrained to an integer number of samples. However, recent implementations often contain trial excitation signals which correspond to noninteger delays. In a conventional CELP algorithm, the inclusion of noninteger delays was shown to increase performance at a relatively small cost in bit rate (see P. Kroon, B. S. Atal, "On the Use of Pitch Predictors with High Temporal Resolution", *IEEE Trans. Signal Processing*, Vol. 39, p. 733–735, (1991) ). Trial excitation vectors corresponding to noninteger delays can be obtained by band-limited interpolation of the signal sequence forming the adaptive codebook. Usually one additional bit is spent for the increased time resolution of the adaptive codebook. A total bit allocation of 8 bits for the adaptive-codebook-vector index is commonly used.

The fixed-codebook contribution is determined in the second stage of the determination of the quantized excitation signal. During the determination of the fixed-codebook contribution, the adaptive codebook contribution is set to its optimized value, determined with the method described above. The fixed-codebook vector provider 105 contains a fixed codebook with K entries, where K commonly varies between 64 and 1024. K is usually an integer power B of 2, $K=2^B$, to facilitate an efficient binary implementation. Each of the fixed-codebook vectors contained in the fixed codebook is used to generate a quantized excitation signal. Each of these vectors is added to the optimized adaptive codebook contribution by adder 106, and the resulting trial excitation is converted into a trial speech signal in filter 102. This trial speech signal is compared to the original speech signal by perceptual-error evaluator 110, and the best matching fixed-codebook vector is selected. The index of the best fixed-codebook vector is encoded in B bits and transmitted to the receiver. Again, during the search procedure the gain of the fixed-codebook vector is set to its optimal value using conventional procedures. Upon selection of the best-matching fixed-codebook contribution, the fixed-codebook gain is quantized and its quantization index transmitted to the receiver.

In the above discussion, the treatment of the filter memory of LP synthesis filter 102 was not discussed for clarity of explanation. This filter memory determines the zero-input response of the filter which often provides a larger signal contribution than the zero-state response (which is due to the current-subframe excitation). Thus, it is important to use the correct filter memory in 102. Prior to each generation of a trial speech signal, the filter memory should be reset to the state in which it was left at the end of the previous subframe, for the optimal excitation signal. Note that the optimal excitation signal is the excitation used by the receiver, and that the reset operation insures that the transmitter and receiver are completely synchronized (assuming zero channel errors). Actual implementations of LPAS algorithms often use algorithms which are mathematically equivalent to those reported here, but which have been changed in order to lower the required computational effort.

In the above discussions the terms "adaptive codebook" and "pitch predictor" were assumed to be equivalent. For the case where the subframe is shorter or equal to the delay this is correct. For the case where the subframe is longer than the delay the two are usually given different interpretations. The adaptive codebook can be extended to include this case by procedures discussed in W. B. Kleijn, D. J. Krasinski, R. H. Ketchum, "An Efficient Stochastically Excited Linear Predictive Coding Algorithm for High Quality Low Bit Rate Transmission of Speech", *Speech Communication* Vol. 7, p. 305–316 (1988). This extension means that the adaptive codebook is not equivalent to a stationary pitch-prediction filter within the subframe, but simplifies the computational effort as compared to a (filter-based) pitch predictor. However, these differences are of no particular relevance to the present invention, which is valid independent of whether an adaptived codebook or pitch predictor is used, regardless of the relation between the subframe and the delay.

For clarity, the bit allocation of an illustrative CELP coder is now summarized. The code for each subframe of a CELP coder consists of the index to the adaptive codebook vector, the index to the gain of the adaptive codebook vector, and the index to the fixed-codebook vector and the index to the gain of the fixed-codebook vector. In addition for each frame a set of indices which determines the linear prediction coefficients is transmitted. Vector quantization procedures such as those presented in, e.g., K. K. Paliwal, B. S. Atal, "Efficient Vector Quantization of LPC Parameters at 24 Bits/Frame" *IEEE Trans. Speech Audio Process.*, Vol. 1 p. 3–14, (1993) are commonly used for these parameters, allowing a 30 bit allocation. Table 1 provides a typical bit allocation for a conventional 6.3 kb/s CELP coder.

TABLE 1

Example Bit Allocation for 6.3 kb/s CELP coder

| Parameter | Bit Allocation | Update (Hz) |
|---|---|---|
| Prediction Coefficients | 30 | 50 |
| Adaptive-Codebook Vector | 8 | 200 |
| Adaptive-Codebook Gain | 4 | 200 |
| Fixed-Codebook Vector | 8 | 200 |
| Fixed-Codebook Gain | 4 | 200 |

An Illustrative Embodiment for Speech-Rate Modification in LPAS Coders

The illustrative embodiment of the present invention concerns a system for changing the speech rate of a speech signal. For a given sequence of words (or speech units, such as phonemes) the "speech rate" of a signal representing the sequence can be defined as the number of words (or speech units) per unit time. The speech signal processed by the embodiment is a filter excitation signal generated by a speech decoder (or synthesizer). The decoder generates this signal based on coded speech parameters stored in a memory. These coded speech parameters are illustratively those generated by the speech coder embodiment of FIG. 1. (It will be understood by those of ordinary skill in the art that the coder of FIG. 1 is merely illustrative of coders capable of generating coded speech from which a filter excitation signal may be generated.)

Figure 3:
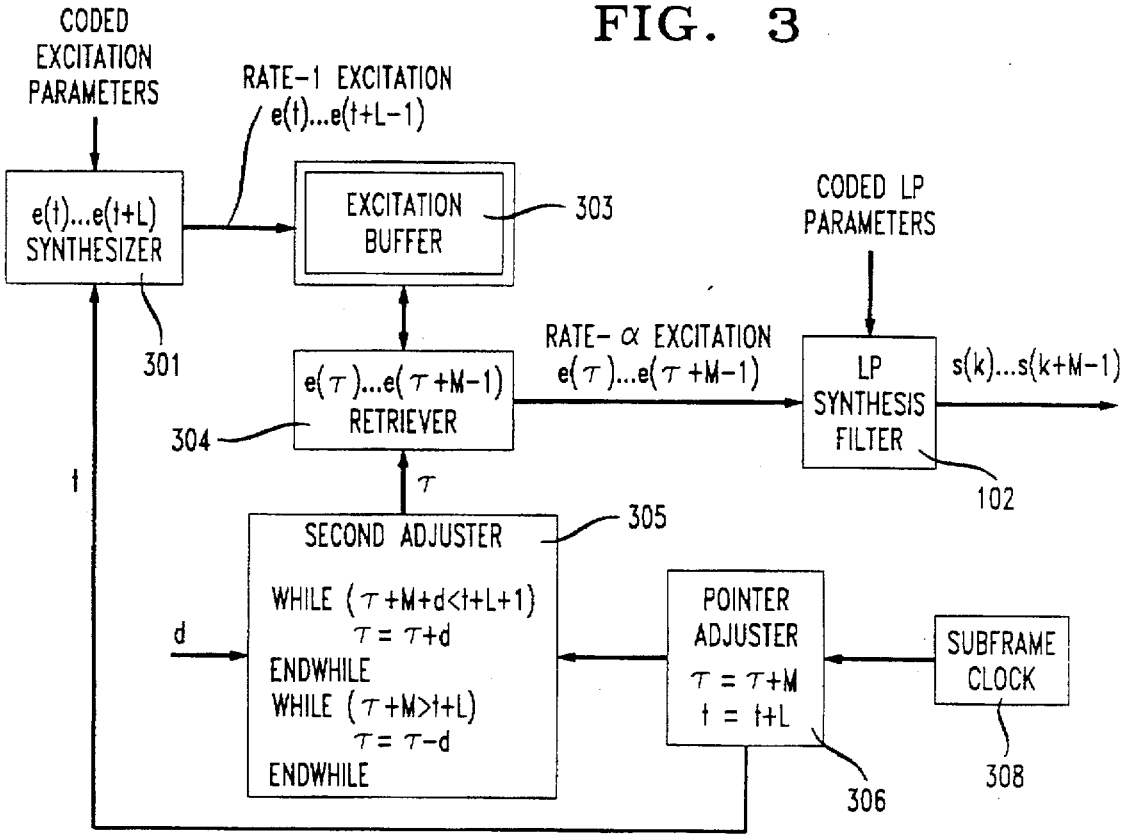
FIG. 3 presents an illustrative rate-change mechanism according to the present invention.

The illustrative embodiment of the present invention is presented in FIG. 3. In this embodiment, the speech decoder (synthesizer) which generates the filter excitation signal is shown at block 301. In terms of the coder of FIG. 1, the synthesizer of FIG. 3 comprises the fixed and adaptive codebook processing system shown at 301. Block 301 receives coded speech parameters of the type described above (and summerized in Table 1), and uses such parameters (adaptive codebook index and gain, and fixed codebook index and gain) to synthesize a filter excitation signal in the same manner shown in FIG. 1 (blocks 103–106). Because the components of block 301 are conventional in the art, they have not been illustrated in detail in FIG. 3.

In LPAS coder systems, the short-term correlation of the excitation signal has a mean which is close to zero. (It is assumed that such correlations are obtained by averaging over windows of approximately 20–30 ms in length.) Thus, the short-term correlation of this signal, and, thus, of the associated reconstructed speech signal, is not disturbed when a pitch-cycle is inserted or removed. When a voiced speech signal is modified in speech-rate, pitch cycles must be inserted or removed from the excitation signal. FIG. 3 presents an illustrative embodiment for inserting or removing pitch cycles.

In the embodiment of FIG. 3, the output subframes are of length M whereas the length of the subframes was L during analysis ($L \neq M$ for a change of rate). The ratio $\alpha = M/L$ is defined here as the rate change of the output signal. The embodiment of the changed-rate synthesis process requires a total of three time pointers. The time pointer t corresponds to the beginning of the present subframe in the rate-1 signal. The rate-1 signal is the excitation signal which preserves the original time scale ($\alpha=1$). This rate-1 signal is always reconstructed independent of the final rate of the output signal. The time pointer $\tau$ is a second pointer into the rate-1 signal. It corresponds to the beginning of the present subframe for the rate-$\alpha$ signal. Finally, k is the (output-signal) time at the beginning of the current subframe. The input-time pointer t increases by L for each subframe and the output-time pointer k increases by M for each subframe. The time pointer $\tau$ is used to modify the rate-1 excitation signal into a rate-$\alpha$ excitation signal.

The case of $\alpha<1$ (speed up) will be discussed first. The subframe clock 308 produces one pulse at the beginning of each output subframe, which corresponds to one pulse every M output samples. At that time, the time pointer t is increased by L in pointer adjuster 306: $t=t+L$. This prompts the excitation synthesizer 301 (which includes adaptive-codebook vector provider 104 and stochastic-codebook vector provider 105 as shown in FIG. 1), to produce a subframe of L samples of rate-1 excitation, with input-time indices t, t+1, . . . , t+L−1. Synthesizer 301 adds these samples to the end of the excitation buffer 303 (to maintain a finite memory, buffer 303 can have a circular structure, with the latest samples overwriting the oldest samples of the buffer). From this same buffer, a rate-$\alpha$ excitation signal will be retrieved.

Also at the beginning of each subframe, pointer adjuster 306 adjusts the time pointer $\tau$: $\tau=\tau+M$ (i.e, $\tau$ increases by the length of the output subframe). First, assume that second adjuster 305 does not change $\tau$. Then retriever 304 retrieves samples $e(\tau)$ through $e(\tau+M-1)$ from buffer (no rate adjustment) 303. These samples are provided as input to the LP filter 102 which produces M output samples s(k), . . . , s(k+M−1). For each L samples of input speech (time scale t), this system produces M output samples (time scale k).

The actual rate change is obtained by moving the time pointer $\tau$ forward by a pitch period whenever required. Note that if such jumps of $\tau$ are not included in the system, then the pointer $\tau$ will run out of the buffer 303 at the past end of the stored data (every M output samples it lags and additional L−M samples behind on t). The forwarding of the pointer $\tau$ is done in second pointer adjuster 305. The pointer is forwarded by the delay d whenever the pointer $\tau$ cannot run out of the future end of buffer 303 within the current subframe, i.e. whenever $\tau+M+d \leqq t+L$. Note that the delay d should be the delay valid at input time $\tau+d$ (and not the delay valid at time $\tau$).

Figure 4:
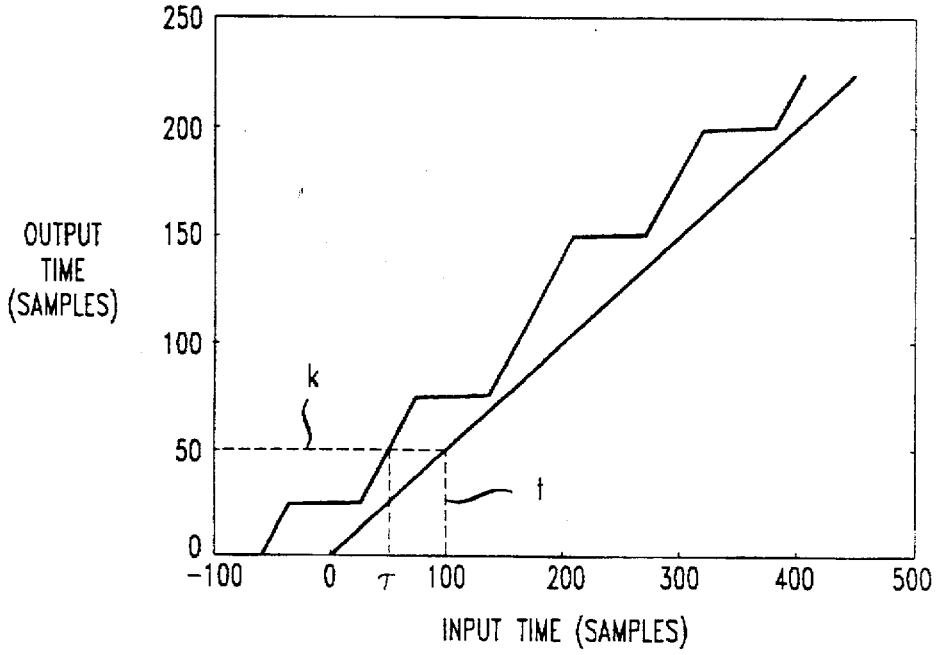
FIG. 4 presents the mapping of a rate-1 to a rate-0.5 excitation signal.

FIG. 4 shows the relationship obtained between the input time t and the output time k with the above rate-change procedure for L=50, M=25, and a fixed delay of 60, all in samples. The slope of 0.5 of the straight line corresponds to the rate $\alpha$ of the rate-0.5 output speech. The stepped curve shows the mapping between the input rate-1 excitation signal and the rate-0.5 excitation signal. The horizontal segments of this curve correspond to segments of the rate-1 excitation signal which are skipped in the rate-0.5 excitation signal. The steps occur only at the subframe boundaries of the output time scale, where the second pointer adjuster 305 is active. The rate-0.5 excitation, which is fed to the LP filter 102, comprises a concatenation of segments of the rate-1 excitation signal. Between these segments skipped segments of rate-1 excitation appear. The used segments of rate-1 excitation have a slope of 1 in FIG. 4.

Next the case where $\alpha=M/L$ is larger than 1 (slow down) will be discussed. As before, pointer adjuster 306 moves the time pointer t forward by L samples and the time pointer $\tau$ forward by M samples for each subframe. Thus, synthesizer 301 produces L excitation samples, and deposits these L samples into buffer 303. However, the number of samples M that the retriever 304 removes from the buffer 303 is now larger than the number of samples L deposited into it by 302. Thus, without the proper rate-change (i.e. backward jumps in $\tau$) the time pointer $\tau$ would run out of the buffer at the future end of the stored data. The rate change is implemented by the second pointer adjuster 305, which moves the time pointer $\tau$ backward by the delay d whenever the time pointer $\tau$ will exceed t within the present subframe. That is, the time pointer $\tau$ is moved backward by d whenever $\tau+M>t+L$.

Figure 5:
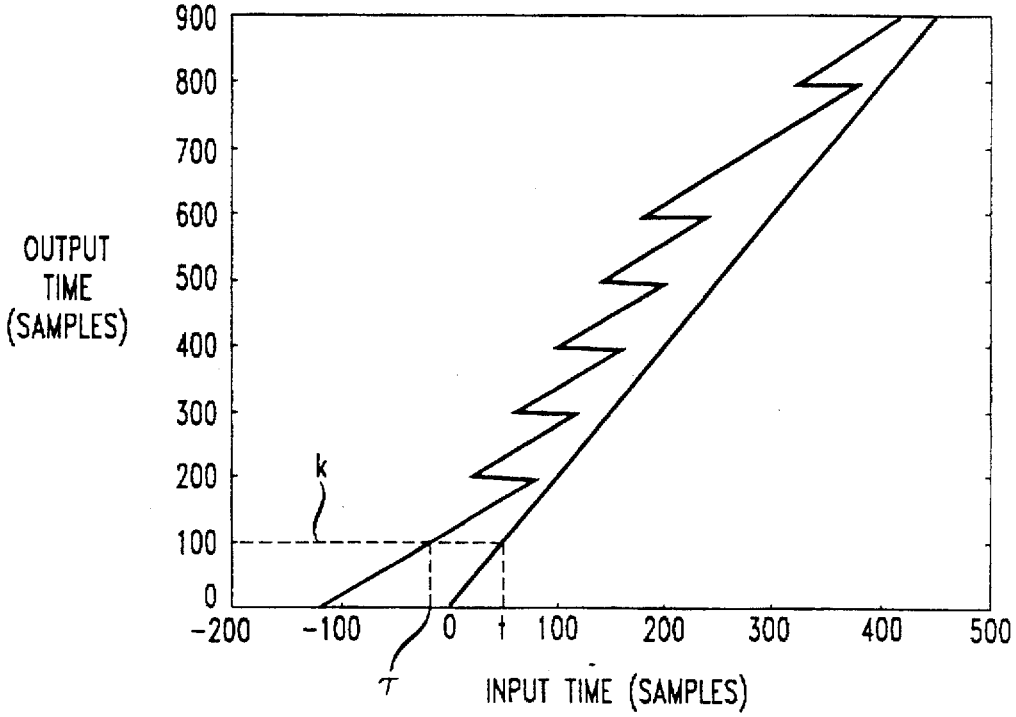
FIG. 5 presents the mapping of a rate-1 to a rate-2 excitation signal.

FIG. 5 shows the relationship between the input time pointer t and the output time pointer k for the case where $\alpha=2$, L=50, M=100 and the delay is constant at d=60. The slope of the straight line is $\alpha=2$. The second curve shows the mapping between the rate-1 excitation and the rate-2 excitation. At the beginning of each output subframe (every 100 samples) the condition $\tau+M>t+L$ is checked, and the time pointer moved backward by d whenever this condition is met. The delay d is the delay valid for input time $\tau$. These backward jumps are shown in FIG. 5 as horizontal segments. The rate-2 excitation comprises a concatenation of overlapping rate-1 excitation segments. These segments are characterized by a slope of 1 in the mapping curve.

The rate-change procedure described above is presented in the context of voiced (quasi-periodic) speech as an example. The same procedure can be used for unvoiced speech. For $\alpha<1$ (speed-up) this provides excellent performance, because removal of segments does not change the low periodicity of the rate-1 excitation significantly. However, for $\alpha>1$ (slow-down), segments of length d are repeated, and this can lead to increased periodicity, and, as a result, audible distortion in unvoiced speech. However, if the delay changes rapidly from one subframe to the next, the increase in periodicity is relatively modest, and the slowed-down speech is of good quality. It is therefore advantageous to use pitch predictors which do not lead to a smooth delay track during unvoiced speech.

Refinements to the Rate-Change Procedure

The basic procedure described above leads to good rate-change performance. The refinements described below further improve this performance.

When the pitch period is longer than the frame length, the current subframe occasionally does not contain pitch pulses. In this situation, the delay d may not be reliable. Thus, it is beneficial to prevent jumps in the time pointer $\tau$ (in second adjuster 305) in such subframes. The frames where d is not reliable can be identified in the rate-1 excitation signal by either 1) comparing the current-subframe energy with the average subframe energy of the last few subframes, or 2) by comparing the current-subframe pitch-predictor gain with the average pitch predictor gain of the last few subframes. If the energy measure is used, no jumps in the time pointer $\tau$ should be allowed if the current subframe energy is lower than that of the average value. Similarly, if the current pitch-predictor gain is lower than the average value, then no jumps in $\tau$ should be allowed. The average values of either the energy or pitch-predictor gains can be replaced by the output of a so-called "leaky integrator" (which has the energy or pitch predictor gain as input), a well-known method which reduces computational and storage requirements.

Of course, even when in certain subframes no jumps are allowed, $\tau$ should be constrained so that it will not run out of the buffer. This can be considered a "master" constraint which can never be violated. Thus, to allow occasional "no-jump" subframes for the case that $\alpha<1$ (which runs out of the past end of the buffer) an increase in the buffer size is required. Thus, if the first sample in buffer 303 is located at $\tau_0$, then $t-t_0$ should be increased. Let E be the energy of the current subframe, and let $\bar{E}$ be the average energy of the last 5 subframes. Improved performance is obtained if the first condition of 305 is replaced by:

while $$((\tau+M+d<t+L \,\&\&\, E>\bar{E}) \,||\, \tau+M<t_0+L)$$

$$\tau=\tau+d$$

endwhile where && is a logical and, and || is a logical or. The above condition means that while both $\tau+M>t+L$ and $E>\bar{E}$, and/or while $\tau<t_0$, then $\tau$ is set to $\tau+d$. The last condition prevents the time pointer $\tau$ from ever leaving the buffer.

For the case that $\alpha>1$, a "no-jump" frame may result in the pointer $\tau$ to run out of the future end of buffer 303. Thus, to prevent this from happening, an additional set (buffer) of samples must be located at the future end of the buffer. Let this additional set be B samples. Then, the second condition in 305 can be replaced by the following condition:

while $$((\tau+M>t+L-B \,\&\&\, E>\bar{E}) \,||\, \tau+M>t+L)$$

$$\tau=\tau-d$$

endwhile

This condition means that while both $\tau+M>t+L-B$ and $E>\bar{E}$, and/or while $\tau+M<t+L$, then $\tau$ is set to $\tau-d$. Again, the last condition prevents $\tau$ from running out of the buffer.

Note that a delay d valid at an input time t is the distance into the past where a similar segment of excitation is located. Each sample of the rate-1 excitation signal has an associated delay. Therefore, the time-pointer $\tau$ can be associated with a delay. When a jump is made in the pointer $\tau$, the distance d of the jump should always refer to the delay at the future end of the jump. Thus, in the case of $\alpha<1$ where the jump is made in the forward direction, the jump distance should equal the adaptive-codebook delay d valid at $\tau$ just after the jump has taken place. However, for $\alpha>1$, where the jump is made in the backward direction, the jump distance should equal the adaptive codebook delay d valid at $\tau$ just before the jump has taken place.

If B is large for the case that $\alpha>1$, and/or for large pitch periods, the time separation between the time pointer $\tau$ and the pointer t can be significant. In practice, time separations of up to 20 ms can occur. For good quality speech it is important to use the linear-prediction coefficients in filter 102 which are appropriate for the input-time $\tau$, and not those appropriate for input time t. In most LPAS coders, each subframe has its own set of linear-prediction coefficients. The correct linear prediction coefficients are those associated with the subframe corresponding to input-time $\tau$.

Dictation Mode

Many messages contain a significant amount of silence. Silence is an absence of speech sounds but may include background noise, such as music, hiss and other non-speech signals. It is common practice to remove these silence intervals for speech with increased rate ($\alpha<1$). When the speech signal is slowed down, the silences are normally increased in duration by the same factor. However while long silences are not annoying, speech which is slowed down by a factor of more than 1.5 often sounds annoying. Yet, a slow-down factor 1.5 or even 2 is often not sufficient for writing down a message. Thus, a new procedure, which will be called "dictation mode", is introduced here.

In dictation mode the speech segments of the signal can be slowed down or can be played out at the regular rate. However any detected silence intervals are increased in duration by a large factor (e.g. 5), the factor being determined by the user or system designer such that it becomes possible to write down the message while it is being spoken. For silence detection new or existing voice-activity-detection methods (including the well-known system used for the GSM 13 kb/s coder) can be used.

To prevent increasing the silence intervals within words, it may be useful to increase the length of a silence interval only for the longer of the detected silence intervals. One can select these longest intervals as follows: for a section of speech, order the detected silence intervals according to their duration, and select the top X longest intervals, where the number X forms a predetermined fraction of all silence intervals. Once they are determined, the duration of these X intervals can be increased by a factor which is larger than that of the rate-change of the speech segments of the signal. Note that the dictation mode can be used for any rate-change system and is not restricted to those used in conjunction with speech coding systems.

Discussion

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention.

Also, the present invention has direct application to many communication products and services where a speech signal is stored in compressed (coded) form for later playback. Thus, the present invention has applicability to telephone answering systems, whether based at a consumer location or based in a telecommunications network. As such, the present invention may be used to provide a speed-up/slow-down feature for review of stored telephone messages, for example. When embodied in, for example, a home or office telephone answering system, the speed-up/slow-down feature of the system may be accessed at the touch of a button. When embodied in a network, the speed-up/slow-down feature of the network-based messaging service may be accessed by conventional signalling protocols using touch-tones (DTMF signals). Whether consumer or network based, such embodiments of the present invention may be realized substantially as shown in FIG. 3, with coded speech parameters supplied by a speech coder/memory system which is consumer or network-based, respectively, and with a synthesized speech signal played to a consumer either locally or via a telecommunications network.

A illustrative network messaging service in accordance with the present invention plays recorded messages to a message recipient at a network terminal, such as a conventional telephone. The network includes a node which includes a memory for storing coded speech parameters representative of a speech message recorded for the message recipient. The network node responds to control signals from the network terminal by playing an audible version of the recorded message at a speech rate different than the speech rate of the recorded message. In responding to the control signals, the node synthesizes a speech signal based on coded speech parameters stored in the memory. The node generates a modified speech-rate signal based on the synthesized speech signal, and filters the modified speech-rate signal to generate a speech signal having increased short-term correlation compared with the modified speech-rate signal. Once the filtered signal is generated, it is transmitted to the network terminal.

An illustrative telephone answering system in accordance with the present invention includes (in addition to conventional elements such as user and telephone interfaces and a network interface) a speech coder for generating parameters representing a speech message for a recipient; a memory for storing parameters generated by the speech coder; a speech decoder for synthesizing a speech signal based on parameters stored in the memory; a processor which generates a modified speech-rate signal based on the synthesized speech signal and filters the modified speech-rate signal to generate a speech signal having increased short-term correlation compared with the modified speech-rate signal. The system naturally includes conventional apparatus for playing the speech signal having increased short-term correlation to a message recipient in audible form.

I claim:

1. A method of decoding an encoded original speech signal to produce a decoded speech signal having a different speech rate than the original speech signal, the encoded original speech signal comprising coded excitation parameters and coded linear prediction parameters, the method comprising the steps of:

synthesizing an original speech-rate excitation signal based on one or more of the coded excitation parameters;

generating a modified speech-rate excitation signal based on a signal representing a predetermined change of speech-rate and on the original speech-rate excitation signal; and filtering the modified speech-rate excitation signal based on one or more of the coded linear prediction parameters to generate the decoded speech signal.

2. The method of claim 1 wherein the step of generating the modified speech-rate excitation signal comprises the step of inserting in the original speech-rate excitation signal a previous sequence of samples corresponding substantially to a pitch cycle.

3. The method of claim 1 wherein the step of generating the modified speech-rate excitation signal comprises the step of removing from the original speech-rate excitation signal a sequence of samples corresponding substantially to a pitch cycle.

4. The method of claim 1 wherein at a sample of index k of the modified speech-rate excitation signal, the original speech-rate excitation signal is stored in a buffer up to a sample of index t; wherein for every M samples of the modified speech-rate excitation signal generated, there are L additional samples of the original speech-rate excitation signal stored in the buffer; wherein $\tau$ is an index of a sample of the original speech-rate excitation signal which is the sample of index k of the modified speech-rate excitation signal; wherein $\tau$ increases by one sample for each sample of the modified speech-rate excitation signal; and wherein the step of generating the modified speech-rate excitation signal comprises changing the value of $\tau$ by substantially one pitch cycle based on a difference between t and $\tau$.

5. The method of claim 1 wherein the step of filtering is performed with an LPC synthesis filter.

6. The method of claim 1 wherein the step of generating the modified speech-rate excitation signal comprises the step of storing L samples of the original speech-rate excitation signal in a buffer memory and retrieving M samples from the buffer memory, said retrieved samples forming the modified speech-rate excitation signal, wherein $L \neq M$.

7. The method of claim 6 wherein the ratio M/L is based on said signal representing the predetermined change in speech-rate.

8. The method of claim 7 wherein L is a number of samples which corresponds to a subframe of a speech coder.

9. The method of claim 1 wherein the coded excitation parameters comprise an adaptive codebook index and an adaptive codebook gain index.

10. The method of claim 1 wherein the coded excitation parameters comprise a fixed codebook index and a fixed codebook gain index.

11. An apparatus for decoding an encoded original speech signal to produce a decoded speech signal having a different speech rate than the original speech signal, the encoded original speech signal comprising coded excitation parameters and coded linear prediction parameters, the apparatus comprising:

means for synthesizing an original speech-rate excitation signal based on one or more of the coded excitation parameters;

means for generating a modified speech-rate excitation signal based on a signal representing a predetermined change in speech-rate and on the original speech-rate excitation signal; and means for filtering the modified speech-rate excitation signal based on one or more of the coded linear prediction parameters to generate the decoded speech signal.

12. The apparatus of claim 11 wherein the means for generating the modified speech-rate excitation signal comprises means for inserting in the original speech-rate excitation signal a previous sequence of samples corresponding substantially to a pitch cycle.

13. The apparatus of claim 11 wherein the means for generating the modified speech-rate excitation signal comprises means for removing from the original speech-rate excitation signal a sequence of samples corresponding substantially to a pitch cycle.

14. The apparatus of claim 11 wherein the means for filtering comprises an LPC synthesis filter.

15. The apparatus of claim 11 wherein the coded excitation parameters comprise an adaptive codebook index and an adaptive codebook gain index.

16. The apparatus of claim 11 wherein the coded excitation parameters comprise a fixed codebook index and a fixed codebook gain index.

17. The apparatus of claim 11 further comprising a memory storing said coded excitation parameters.

18. The apparatus of claim 11 wherein the means for generating a modified speech-rate excitation signal comprises a buffer memory for storing L samples of the original speech-rate excitation signal.

19. The apparatus of claim 18 further comprising means for retrieving M samples from the buffer memory, said retrieved samples forming the modified speech-rate excitation signal, wherein $L \neq M$.

20. The apparatus of claim 19 further comprising means for controlling the retrieval of M samples from the buffer.

21. A method of providing a telecommunications network messaging service, the service for playing recorded messages to a message recipient at a network terminal, the network including a node having a corresponding memory storing coded speech information, the coded speech information representing a speech message recorded for the message recipient and comprising coded excitation parameters and coded linear prediction parameters, the network node responsive to control signals from the network terminal for playing an audible version of the recorded message, the method comprising the steps of:

receiving at the node a control signal from the network terminal, the control signal requesting a modification of speech-rate of the recorded message;

synthesizing an original speech-rate excitation signal based on one or more of the coded excitation parameters stored in the memory;

responsive to the control signal, generating a modified speech-rate excitation signal based on the synthesized original speech-rate excitation signal;

filtering the modified speech-rate excitation signal based on one or more of the coded linear prediction parameters to generate a decoded speech signal having a modified speech-rate as compared to the recorded message; and transmitting the decoded speech signal to the network terminal.

22. A telephone answering system comprising:

a speech coder for generating parameters representing an original speech message for a recipient, the parameters including excitation parameters and linear prediction parameters;

a memory for storing one or more of the excitation parameters generated by the speech coder;

means for synthesizing an original speech-rate excitation signal based on one or more of the excitation parameters stored in said memory;

means for generating a modified speech-rate excitation signal based on the synthesized original speech-rate excitation signal;

means for filtering the modified speech-rate excitation signal based on one or more of the linear prediction parameters to generate a decoded speech signal having a modified speech rate as compared to the original speech message; and means for playing the decoded speech signal to a message recipient.

* * * * *